United States Patent [19]

Knecht

[11] 4,429,837

[45] Feb. 7, 1984

[54] BLADE ASSEMBLY FOR MEAT CHOPPER

[76] Inventor: Fritz Knecht, D-7981 Heissen-Vogt, Fed. Rep. of Germany

[21] Appl. No.: 324,977

[22] Filed: Nov. 25, 1981

[30] Foreign Application Priority Data

Nov. 27, 1980 [DE] Fed. Rep. of Germany ..... 3044632

[51] Int. Cl.[3] ..... B02C 18/20

[52] U.S. Cl. ..... 241/292.1; 83/664; 241/282.2

[58] Field of Search ..... 241/282.1, 282.2, 292.1; 83/664

[56] References Cited

U.S. PATENT DOCUMENTS 3,279,296 10/1966 Jung et al. ..... 83/664
3,871,590 3/1975 Steffens ..... 241/292.1 X
3,897,020 7/1975 Knecht ..... 241/292.1

FOREIGN PATENT DOCUMENTS 1086580 8/1960 Fed. Rep. of Germany ... 241/292.1

*Primary Examiner*—Carl E. Hall
*Attorney, Agent, or Firm*—Karl F. Ross; Herbert Dubno

[57] ABSTRACT

A blade assembly has a support shaft extending along an axis and having an end member and a polygonal-section portion extending axially from the end member. A plurality of like metallic support disks are supported on this shaft and have central holes traversed by and complementary to the polygonal-section portion and outer peripheries. Respective metallic blades lie flatly axially on the support disks and each have a radially outwardly projecting cutting portion extending radially outwardly past the outer periphery of the respective support disk. The blades with the respective support disks are axially spaced along the polygonal-section portion. Respective fasteners engaged axially through the support disks and the respective blades secure each blade to the respective support disk for joint rotation therewith. A plurality of spacer rings of a polyoxymethylene each engage axially in one direction on one respective blade and the respective support disk and axially in the opposite direction on the adjacent blade and the respective support disk. Another end member screwed onto the support shaft presses the support disks, blades, and spacer rings axially together against the other end member.

10 Claims, 2 Drawing Figures

BLADE ASSEMBLY FOR MEAT CHOPPER

FIELD OF THE INVENTION

The present invention relates to a blade assembly for a meat chopper. More particularly this invention concerns such an assembly which can be disassembled for servicing and repair.

BACKGROUND OF THE INVENTION

A standard blade assembly for a meat chopper is normally carried on a noncircular-section portion of a shaft that is driven about its own axis at high speed. The individual blades of the assembly each have outer cutting portions formed with cutting edges and inner portions bolted or riveted to metallic support disks which each have a central hole complementary to the noncircular-section shaft portion. Normally the noncircular shaft portion is shaped like a regular polygon so the blades can be positioned in any of a plurality of equiangularly offset positions.

Such a system is described in German patent publication No. 2,338,145. In this arrangement the support disks are relatively massive and therefore also serve to space the blades axially apart, elastomeric layers being used to either side of each blade to reduce vibration and keep the assembly tight. Since the blade assembly is used to chop meat it is made of a high-quality steel that can resist the acids and the like it will be subjected to.

Even with such steel support disks, corrosion and metal failure is a problem. The support disks are damaged by so-called cavitation erosion resulting from the combined effect of various chemical agents such as salts, carbohydrates, albumin and water, all combined with various thermal and electrochemical factors that can erode even the toughest steels.

It has therefore been suggested to coat the support disks with a protective layer, such as of polytetrafluorethylene that largely resists chemical attack. Although such an expedient would seem to solve the problem, in practice such a coating is frequently damaged and quickly penetrated. The sharp bone splinters occasionally encountered are enough to breach the coating, leaving the underlaying material open for chemical attack. Even normal handling of thus coated parts can damage the coating.

Another suggestion has been to use light alloy support disks. Although such disks do indeed resist corrosion much better than steel disks, they react with many constituents of food that will pass through the meat chopper. Obviously a meat chopper that imparts a taste to the foodstuff it is processing is unacceptable. Such support disks are also normally extremely rigid, so that any vibration is not damped at all, but instead is effectively transmitted throughout the assembly.

OBJECTS OF THE INVENTION

It is therefore an object of the present invention to provide an improved blade assembly for a meat chopper.

Another object is the provision of such a blade assembly for a meat chopper which overcomes the above-given disadvantages.

A further object is the provision of such a blade assembly which is particularly resistant to corrosion, but no harder to service and handle than the prior-art systems.

SUMMMARY OF THE INVENTON

These objects are attained according to the instant invention in a blade assembly having, as is well known, a support shaft extending along an axis and having an end member and a noncircular-section portion extending axially from the end member. A plurality of like metallic support disks are supported on this shaft and have central holes traversed by and complementary to the noncircular-section portion and outer peripheries. Respective metallic blades lie flatly, that is in surface contact, axially on the support disks and each have a radially outwardly projecting cutting portion extending radially outwardly past the outer periphery of the respective support disk. The blades with the respective support disks are axially spaced along the noncircular-section portion. Means including respective fasteners engaged axially through the support disks and the respective blades secure each blade to the respective support disk for joint rotation therewith. According to this invention, a plurality of spacer rings of a rigid synthetic resin each engage axially in one direction on one respective blade and the respective support disk and axially in the opposite direction on the adjacent blade and the respective support disk. Another end member screwed onto the support shaft presses the support disks, blades, and spacer rings axially together against the other end member.

According to this invention, the synthetic resin is an acetal resin, more particularly, it is polyoxymethylene (POM).

Thus according to the instant invention all corrosible metal parts are replaced or protected by a chemically resistant synthetic resin. Those parts close to the shaft are well protected, which is particularly necessary as in this region centrifugal force does not throw foreign matter off nor is it scraped off by the meat being processed. As a result the service life of the blade assembly of the instant invention is quite long, and it is much easier to service and clean than any of the prior-art assemblies.

According to another feature of this invention, the other end member includes a metallic ring and a nut screwed onto the shaft. The entire package of alternating synthetic-resin spacer rings and metallic blades and their support disks is therefore axially clamped. One such spacer ring further is provided at each end of the pack between the end blade and disk and the respective end member.

In accordance with another feature of the invention each of the spacer rings is formed with an axially open recess snugly receiving the respective support disk. More particularly, the recesses are of an axial depth equal to the axial thickness of the support disks, so that the disks fit flush in the respective recesses. It is therefore possible to use relatively thin support disks. Such construction greatly lightens the blade assembly, as the synthetic-resin spaced rings are much less dense than the thick support disks used hitherto, whether of steel or of an aluminum alloy. In addition these rigid spacer disks have been found to have enough give to effectively damp vibration. Another advantage of such a system is that it is possible to remove and replace a single blade or support disk independently of the others.

According to another feature of this invention the spacer disks are formed with recesses in which the respective bolts are at least partially received. With such a system it is possible to use these bolts to center the blade and support disk in the blade assembly, so that if one support disk does not have the properly dimensioned central hole, it can still nonetheless be clamped and held in properly centered position in the assembly. Thus the instant invention makes it possible to use a spacer disk of a given dimension with many differently sized support disks and blades. Since in the food field it is common to use different blade assemblies for different chopping tasks, the instant invention therefore makes it possible to reduce the stock parts one need carry to service such choppers.

The disks, according to another invention feature, radially overlap at a region with the respective blades. The spacer rings are provided with axially throughgoing rigid pins axially aligned with this region so that force is transmitted axially through the spacer rings by the pins. Thus even if the assembly is tightened greatly, the spacer disks will not be crushed, and the stronger reinforcement pins will transmit the axial force. In addition such pins insure that in large blade assemblies some of the axial force is transmitted directly to the blades and their respective support disks.

It is also possible according to this invention for each of the spacer rings to have a pair of axially oppositely directed faces having outer edges. The spacer disks are each provided on each face adjacent the respective outer edge thereof with a seal ring engaging the respective blade. Thus the corrosible shaft and support disk are completely protected. In fact the instant invention makes it possible to use other than the expensive corrosion-resistant materials that have hitherto been considered necessary for these parts.

DESCRIPTION OF THE DRAWING

The above and other features and advantages will become more readily apparent from the following, reference being made to the accompanying drawing in which.

SPECIFIC DESCRIPTION

Figure 1:
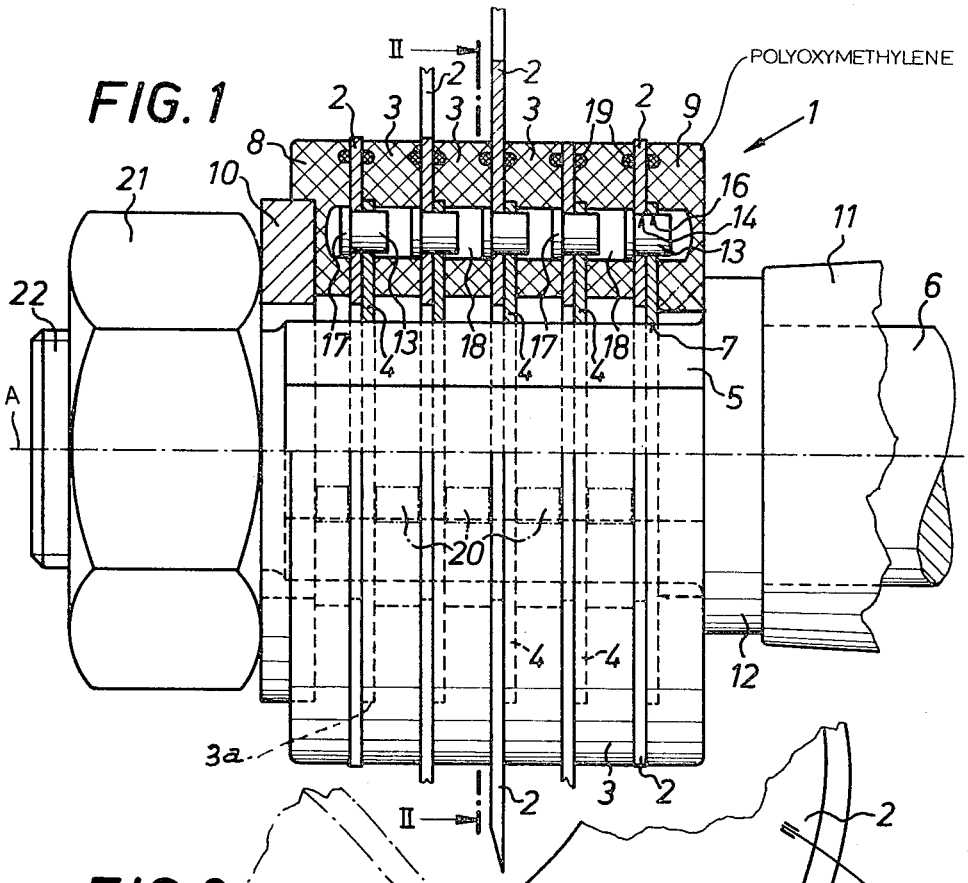
FIG. 1 is a side view partly in axial section through the assembly according to this invention.
Figure 2:
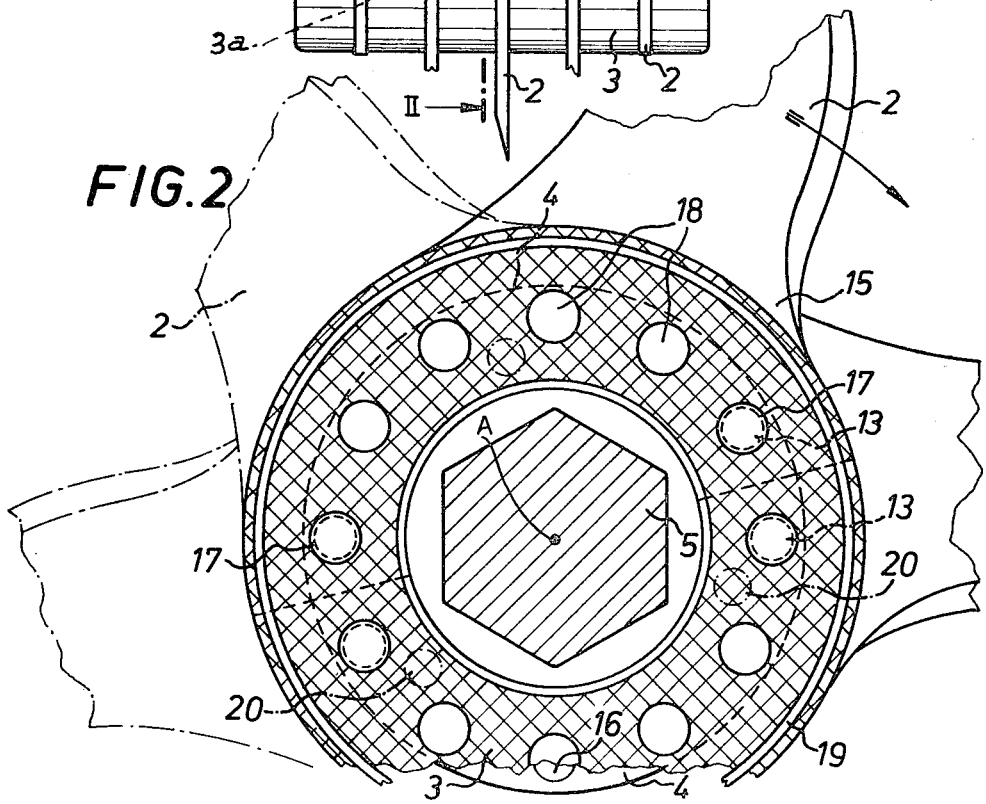
FIG. 2 is a section taken along line II—II of FIG. 1.

A blade assembly 1 according to the instant invention has blades 2 and spacer rings 3 shown in FIGS. 1 and 2. The blades 2 are of steel and have outwardly extending cutting portions 15 and the rings 3 are made of polyoxymethylene, a thermoplastic known for its good fatigue life and high solvent and chemical resistance.

This assembly 1 further comprises support rings or disks 4 carried on a hexagonal-section portion 5 of a shaft 6 centered on an axis A. These disks 4 are of steel and are formed with hexagonal-section holes 7 complementary to the portion 5 so that they can be slid axially thereon, but will be rotationally joined to the shaft 6. The shaft 6 has to one side of the portion 5 a fixed collar 11 against which a pusher ring 12 of steel rests, and to the other side of the portion 5 has a screwthread 22 on which a nut 21 is threaded to bear on a steel pusher ring or washer 10. End spacer rings 8 and 9 of polyoxymethylene bear axially against the pusher rings 10 and 12.

Short rivet-like bolts 13 extend axially through aligned holes 14 and 16 formed respectively in the blades 2 and support disks 4. The spacer rings 3 are formed with holes 18 of the same diameter as the heads 17 of the bolts 13. The holes 14, 16, and 18 are angularly equispaced about the axis A so that the cutting portions 15 of the blades 2 can be angularly set at any of a multiplicity of angularly offset positions.

One face of each of the rings 3 is formed with a cylindrical recess 3*a* of the same depth and diameter as the support disks 4 so that these support disks 4 can be set flush in the respective spacer rings 3. In addition the spacer rings 3 are formed radially inside the holes 18, but still at a region where the blades 2 and disks 4 radially overlap, with axially throughgoing metallic pins 20. These pins 20 transmit axial force directly to the disks 4 and blades 2, so that they will be effectively clamped between the end members 10 and 12.

In addition each face of each of the spacer rings 3, and one face of each of the end rings 8 and 9, is provided immediately inside the outer periphery with an elastomeric seal ring 19 which is flattened against the respective face of the respective blade 2. Thus an effective barrier against moisture is provided, keeping the interior of the blade assembly 1 completely dry.

The system according to the instant invention has been found to have a long service life, as the spacer disks 3 are virtually corrosion proof and effectively protect all of the remaining structure except those portions of the blades 2 which in any case must be exposed. It is possible to replace a damaged blade and/or support disk relatively easily, or to switch blades as necessary for a particular application.

I claim:

1. A blade assembly for a meat cutter, said blade assembly comprising:

a support shaft extending along an axis and having an end member and a noncircular-section portion extending axially from said end member;

a plurality of like metallic support disks having respective central holes traversed by and complementary to said noncircular-section portion and respective outer peripheries;

respective metallic blades bearing in surface contact axially on said support disks and each having a radially outwardly projecting cutting portion extending radially outward past the outer periphery of the respective support disk, said blades with the respective suport disks being axially spaced along said noncircular-section portion;

means including respective fasteners engaged axially through said support disks and the respective blades for securing each blade to the respective support disk for joint rotation therewith;

a plurality of spacer rings of a rigid synthetic resin axially alternating with the blades and the respective disks, each of said rings engaging axially in one direction on one respective blade and the respective support disk and axially in the opposite direction on the adjacent blade and the respective support disk; and another end member screwed onto said support shaft and pressing said support disks, blades, and spacer rings axially together against the other end member.

2. The blade assembly defined in claim 1 wherein said synthetic resin is an acetal resin.

3. The blade assembly defined in claim 2 wherein said acetal resin is polyoxymethylene.

4. The blade assembly defined in claim 2 wherein said other end member includes a metallic ring and a nut screwed onto said shaft.

5. The blade assembly defined in claim 2 wherein each of said spacer rings is formed with an axially open recess snugly receiving the respective support disk.

6. The blade assembly defined in claim 5 wherein said recesses are of an axial depth equal to the axial thickness of said support disks, whereby said disks fit flush in the respective recesses.

7. The blade assembly defined in claim 2 wherein said spacer disks are formed with recesses in which the respective fasteners are at least partially received.

8. The blade assembly defined in claim 2 wherein said disks radially overlap at a region with the respective blades, said spacer rings being provided with axially throughgoing rigid pins axially aligned with said region, whereby force is transmitted axially through said spacer rings by said pins.

9. The blade assembly defined in claim 2 wherein each of said spacer rings has a pair of axially oppositely directed faces having outer edges, said spacer disks each being provided on each face adjacent the respective outer edge thereof with a seal ring engaging the respective blade.

10. The blade assembly defined in claim 2, further comprising two further spacer rings each engaging one of said end members and the adjacent blade.

* * * * *